US005362277A

United States Patent [19]

Meluskey

[11] Patent Number: 5,362,277

[45] Date of Patent: Nov. 8, 1994

[54] PIN GUIDE AND PINSETTING MACHINE

[76] Inventor: Richard Meluskey, 1003 Wool Ave., Franklin Sq., N.Y. 11010

[21] Appl. No.: 100,481

[22] Filed: Aug. 3, 1993

[51] Int. Cl.[5] ..... A63D 5/00

[52] U.S. Cl. ..... 473/94; 473/96

[58] Field of Search ..... 473/89, 90, 94, 95, 473/96, 102

[56] References Cited

U.S. PATENT DOCUMENTS

| | | | |
|---|---|---|---|
| 3,076,651 | 2/1963 | Hicks | 473/94 |
| 3,148,880 | 9/1964 | Terry | 473/94 |
| 3,307,847 | 3/1967 | Kostopoulos et al. | 473/96 |
| 3,526,401 | 9/1970 | Zuercher | 473/96 |
| 4,230,315 | 10/1980 | Camilleri | 473/94 |

*Primary Examiner*—Vincent Millin

*Assistant Examiner*—William M. Pierce

*Attorney, Agent, or Firm*—Gennaro L. Pasquale

[57] ABSTRACT

A bowling pin handling apparatus for use with a bowling pin potting machine comprising a pin storage magazine mounted beneath a cantilevered elongated distributing conveyor. A plurality of pin receiving and storage pockets arranged in a generally triangular pattern or array formation in the magazine receiving pins delivered from the end of the conveyor. Pin guides for the #1 pin pocket include an arched shaped frame supporting a resilient pendent adapted to dampen the movement of the pin as it moves into the pocket, side guides to limit and control yawing of the pin in its movement toward the pocket and extended guide rollers to smooth the transfer of the #1 pin from the distributer to the guide rollers.

9 Claims, 6 Drawing Sheets

PIN GUIDE AND PINSETTING MACHINE

BACKGROUND OF THE INVENTION

In the bowling industry, jamming of pinspotting, or pin spotting, machines constitute a major economic cost to the industry. In addition to the cost for providing personnel to reset the machine, there is a loss of income to the operator when the machine is down.

One particular pinspotting machine in wide use was manufactured and distributed by American Machine Foundry under a type designation of 82-70. There are literally thousands of these machines operating on a daily basis throughout the country. The machine its operations and features are disclosed in detail in U.S. Pat. No. 3,526,401 entitled Pin "Distributing Apparatus with Cantilever Supported Extendable Belt Conveyor" and granted to John Zuercher on Sep. 1, 1970.

While this particular pinspotting machine is generally reliable, the jams do occur on a relatively regular basis. As the pins are fed toward the pin storage magazine assembly by the distributor mechanism there is a tendency for the head pin (#1 pin) to bounce and occasionally a pin will bounce out of position and jam as the pin moves toward the #1 pin storage pocket in the pin storage magazine or shuttle. Naturally when this occurs, the machine stops and it is necessary to unjam the machine and reset the mechanism. Occasionally the jamming will result in breaking parts of the pinspotting machine, thereby necessitating costly and time consuming repairs while the lane is out of service.

One purpose of this invention is to provide an improved mechanism which will reduce the frequency of jamming of the type of pinspotting machine referred to above.

SUMMARY OF THE INVENTION

This invention relates to bowling pinspotting machines, and more particularly to apparatus for distributing and storing pins to be set on a pin deck of a bowling lane.

The present invention relates to a mechanism which receives pins that have been elevated from the pit of a bowling lane, and delivers them one by one into pockets or compartments of a pin storage magazine for subsequent discharge into means, such as pinspotters or cups, which place them in desired playing arrangement on the pin deck of the bowling lane. In the mechanism, the pin distributing mechanism comprises an elongated arm or boom which is constructed and mounted for free movement back and forth above a pin storage magazine and is extended or retracted in order that pins can be delivered therefrom one by one from the end of the boom into selected pockets or compartments according to a predetermined delivery pattern. In accordance with the invention the #1 pin guides are extended and provided with additional guiding and damping means to control, limit and dampen the movement of the #1 pin as it moves from the end of the boom into the #1 pin pocket in the pin storage magazine.

The present invention provides means for a bowling pin handling mechanism which reduces the tendency of bowling pins to jam as they move into their storage pockets or compartments during their orientation.

It is also an object of the present invention to provide a bowling pin handling mechanism which prevents pins from being damaged during their orientation.

Another object of the invention is to provide a field upgrade kit which can be utilized to upgrade and improve a conventional bowling pinspotting machine to improve its ability to properly and efficiently deliver the #1 pin from the distributer to its storage bin.

Still another object of the present invention is to provide a bowling pin orientation device which is easily fitted to existing bowling pinspotting machines and which is simple and economical in its parts and operation.

BRIEF DESCRIPTION OF THE DRAWINGS

With these and other objects not specifically mentioned in view, the invention consists in certain combinations and constructions which will be fully described hereinafter, and then set forth in the claims hereunto appended.

In the accompanying drawings which form a part of this specification, and in which like characters of reference indicate the same or like parts.

DETAILED DESCRIPTION OF THE DRAWINGS

Figure 1:
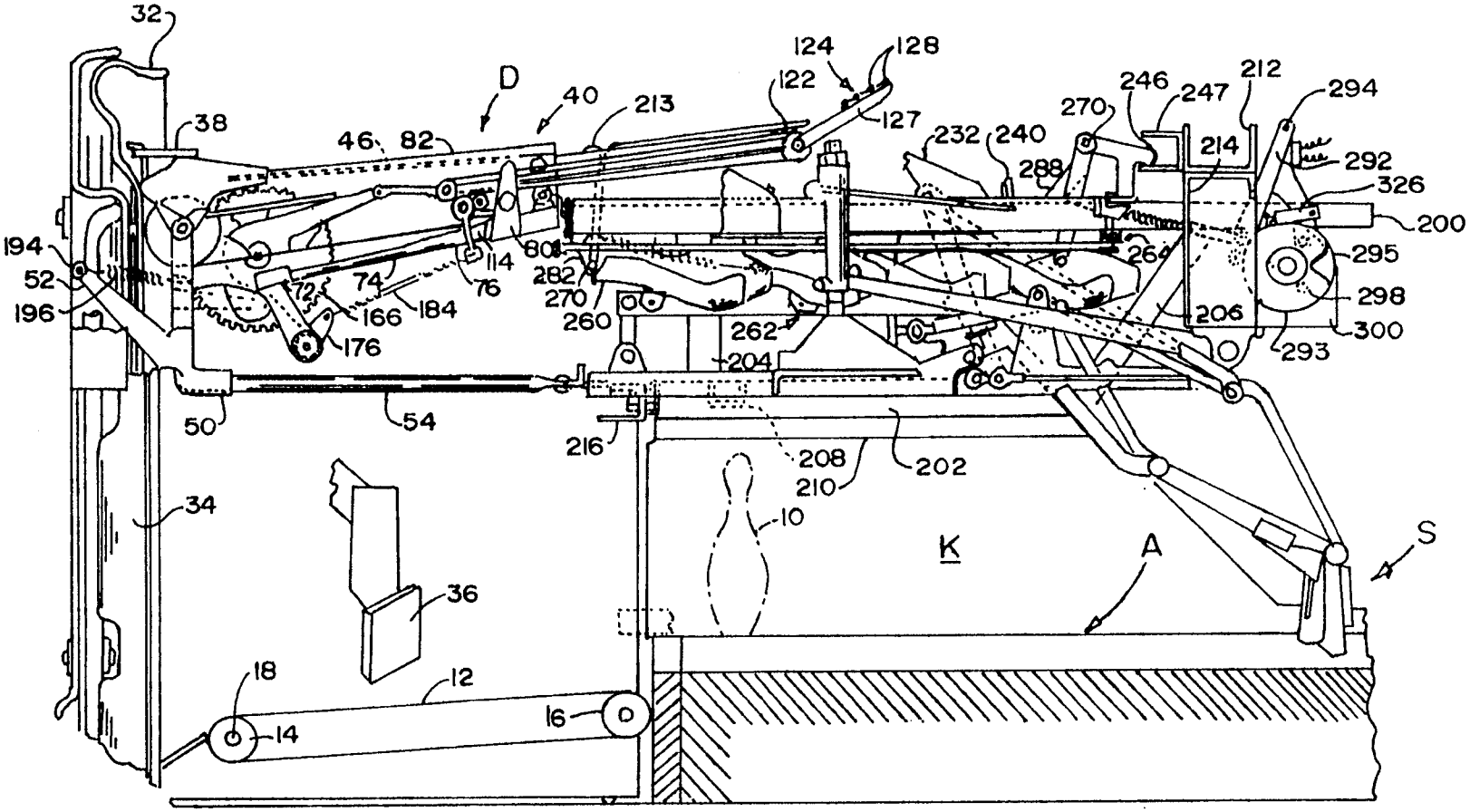
FIG. 1 is a side elevation, partially in section, of a bowling pinspotting machine of the type to which this invention is applicable.

In the description which follows, like parts are marked throughout the specifications and drawings with the same reference numerals, respectively.

While a particular embodiment of the invention has been shown and described, modifications may be made, and it is intended in the appended claims to cover all such modifications as may fall within the true spirit and scope of the invention.

In order to fully disclose a preferred form of the invention it will be described in association with an automatic pinspotting machine of the type similar in construction and operation to that disclosed in U.S. Pat. No. 3,526,401 issued to John Zuerher and entitled "Pin Distributing Apparatus With Cantilever Supported Extensible Belt Conveyor".

Referring to the drawings, bowling pins 10, falling from or removed from lane A by any suitable means, such as sweep S after a bowler has rolled each ball of a frame in the play of the game, drop upon a conveyor or traveling pit-wide apron designated generally 12 in pit P. Sweep S and conveyor 12 may be the same in construction and operation as those shown in Blewitt et al; U.S. Pat. No. 3,248,109. Since these mechanisms form no specific part of this invention, further detailed description and showing thereof is deemed to be unnecessary.

Conveyor 12 runs pulleys 14, 16 suitably rotatably supported in pit P. Shaft 18 of pulley 124 is provided with a pulley (not shown) on which runs a driving belt 20 (FIG. 2) running on a pulley 22 fixed to shaft 24 of a suitable reduction gear motor 26. This motor is also provided with a shaft 28 mounting pulley 30 on which runs belt 32 which travels in a suitable circumferential groove in pin elevating conveyor 34. When the pinspotting machine of which this mechanism forms a part is in operation, motor 26 is in continuous operation.

Bowling balls arriving in pit P are separated from pins 10 by a conventional back-stop 36 suitably supported in pit P. Pins 10 are delivered by conveyor 12 into pockets (not Shown) in elevating conveyor 34 and conveyed thereby to a point of delivery therefrom whence they drop into receiving and orienting member or pan 38 of Distributor D. Conveyor 34 and member 38 may be generally the same in construction and operation as member 182 shown in U.S. Pat. No. 2,767,984. Since they form no specific part of this invention further description and disclosure thereof are omitted in the interest of brevity.

Distributor D, in addition to receiving member or pan 38, is provided with an elongated boom or arm 40 constructed to be extended and retracted in accordance with a predetermined programmed delivery pins from the end of boom 40 into pin receiving compartments or pockets 42 of pin storage magazine 44, described more in detail hereinafter. Boom or arm 40 supports an endless conveyor belt 46 by means of which pins 10 are conveyed from pan 38 for delivery therefrom into pockets 42.

The mechanism illustrated for removing pins from the pit of the bowling alley is not unlike that disclosed in U.S. Pat. No. 3,179,410 issued to James D. Elliott and entitled "Bowling Pin Elevating Mechanism." Pins delivered by the device which removes or elevates them from the pit of the alley are discharged therefrom into a distributing device operatively associated therewith and which may be similar in construction and operation to that disclosed and described in U.S. Pat. No. 3,248,109 issued to Roy E. Blewitt, Jr. and James D. Elliott and entitled "Bowling Pin Distributing Mechanism."

These mechanisms form co-acting and selectively actuated parts of the bowling pinspotting machine with which a control mechanism is operatively connected in such a manner that all sequential and cyclical operations of the machine take place in proper timed order, in spotting and respotting pins upon the playing bed of the bowling alley during the entire course of play of a game after each normal 2-ball frame, or after a strike, or when a foul occurs. While reference is made to the above referred to patents, the present invention may be used with other types of bowling pinspotting or pinsetting machines with which it is adaptable and therefore is not to be considered as limited in use with the structure shown in the above referred to patents.

Figure 2:
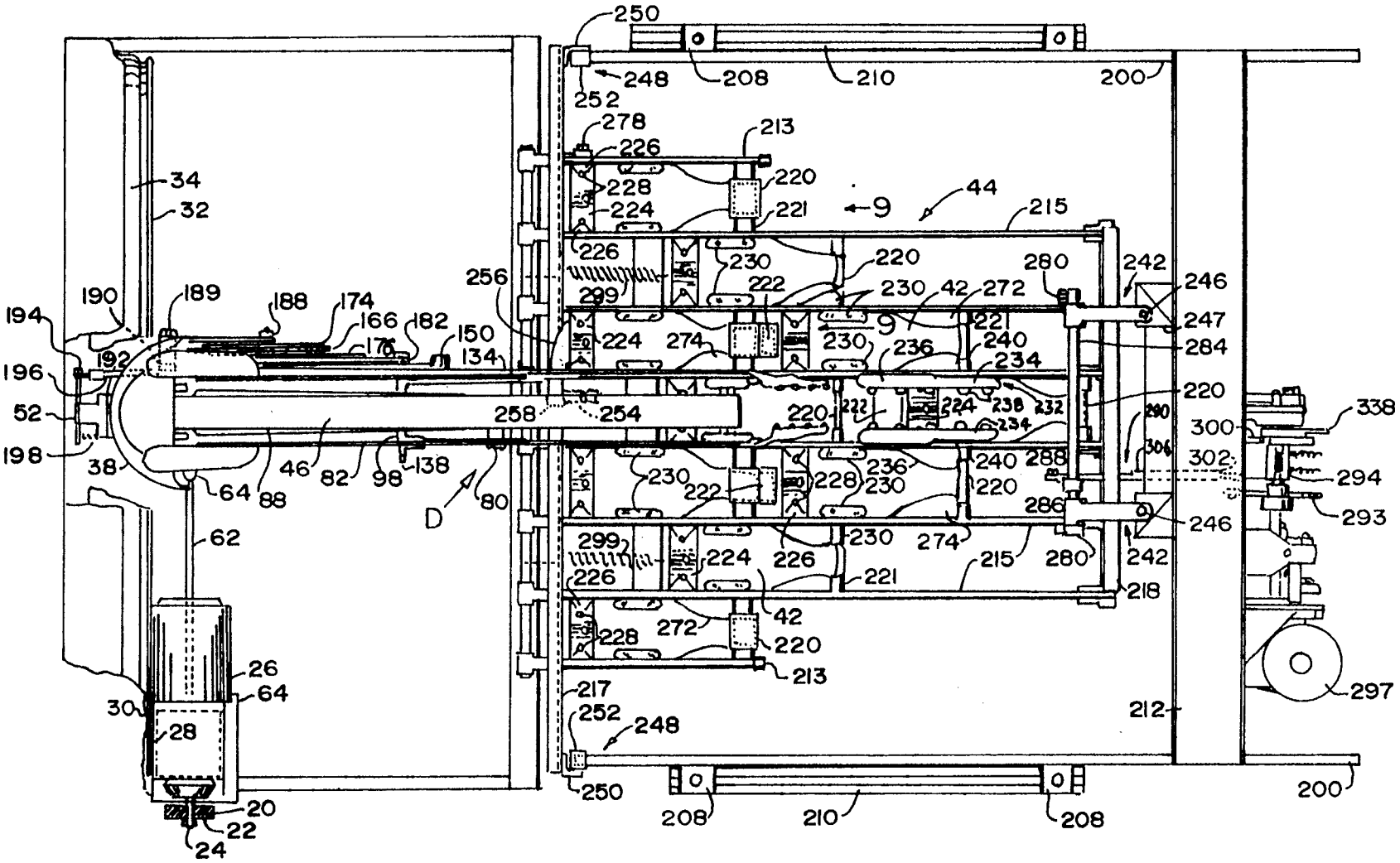
FIG. 2 is a plan view of the pin distributing and setting mechanism of FIG. 1, with parts broken away.
Figure 3:
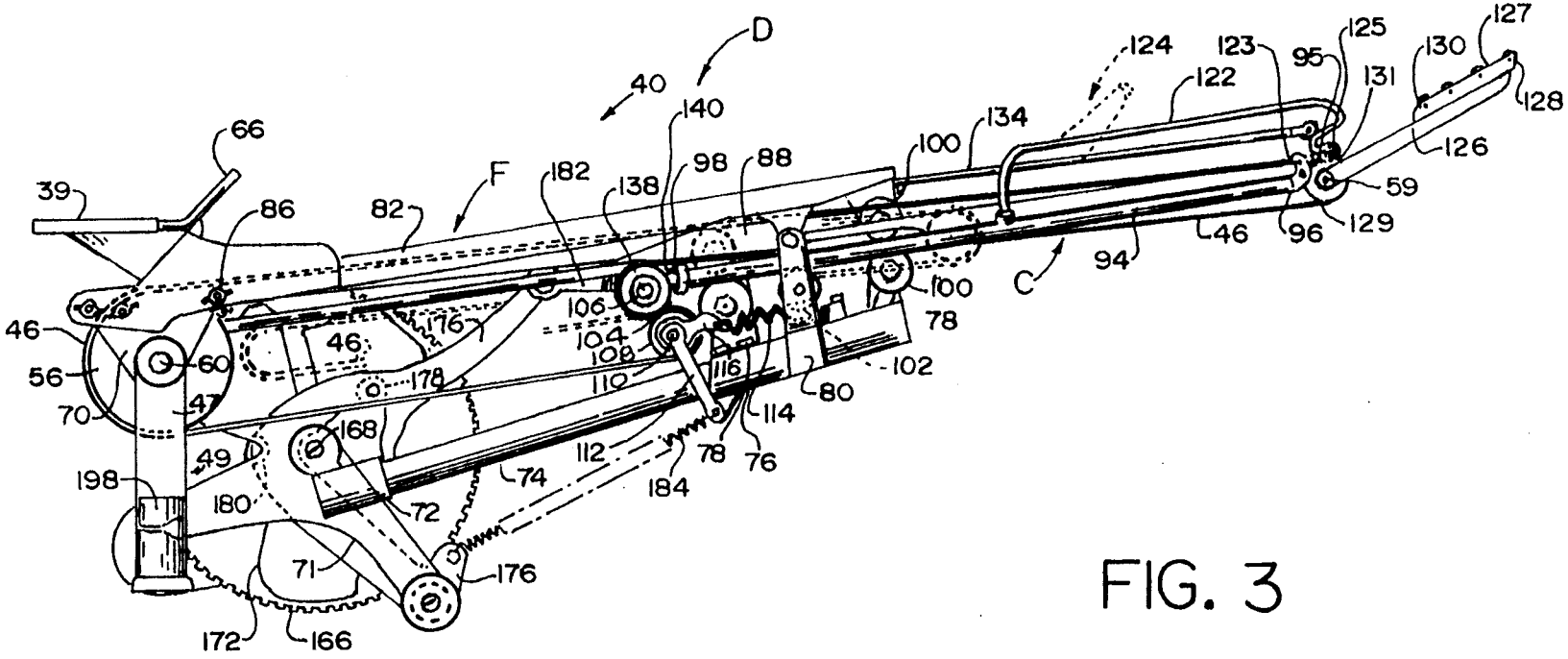
FIG. 3 is a side elevation of the distributor shown in FIG. 1 and FIG. 2.

Referring to FIGS. 1 and 2, it will be seen that distributor D has no connection with pin magazine 44. This provides for complete freedom of movement of distributor D and carriage C. It also provides for assembling and operation of the machine without any need for adjustments of distributor D relative to magazine 44 and for upward movement of magazine 44, if for any reason this should occur during the operation of the machine without breakage of parts or damages thereto.

As shown in FIGS. 1 and 2, the machine illustrated herein is provided with laterally spaced side frames, each consisting of upper and lower horizontal members 200, 202, respectively, joined by a rear upright 204 and an inclined front connecting member 206. Lower member 202 is provided with brackets 208. Bolts (not shown) passing through holes in brackets 208 secure side frame members 202 to mounting rails 210 fixed to the stops of kickbacks K of lane A. Cross channel 212 is connected to brackets 214 which are attached to the front end of frame member 200. Channel 216 connects the rear ends of lower frame member 202. Other suitable cross frame members (not shown) provide a rigid frame structure.

Pin magazine 44 in the embodiment of the invention illustrated herein is provided with ten triangularly arranged components or pockets 42 mounted in a magazine frame.

Referring to FIG. 2, pin pockets 42 which hold pins corresponding to pins #7 and #10 are formed with relatively short exterior side walls 213 and elongated interior walls 215. There are six parallel spaced walls 215 which provide compartments or pockets 42 for pins #1, #2, #3, #4, #5, #6, #8, and #9. The rear ends of walls 213 and 215 are suitably attached to cross channel 217 of magazine 44. The front ends of walls 215 are secured to front channel member 218 of magazine 44.

The lateral distance between walls 212 and 215 and their height is sufficient for accommodating at least one horizontally positioned bowling pin in each pocket. As illustrated herein, each pocket 42 can hold two pins, one pin on top of another. Compartments or pockets 42 are essentially the same in construction. Referring to pocket 42 for pin #10, there is provided a pin butt guide 220 against which the butt end of a pin moves as it enters the pocket. Each guide 220 which forms the front end of a pocket 42 is attached to walls 213 and 215 by suitable conventional resilient shock mount connections which absorb the shock imparted to a butt guide 220 when a pin is delivered into a pocket and also prevent a pin from bouncing around therein.

Each pocket is provided with a pair of spaced downwardly inclined pin guides each extending from a point near the top to a point near the bottom of walls 213 and 215 in the case of pockets 42 of pins #7 and #10, these guides insure the proper movement of pins downwardly into a pocket 42 there spacing is such that they support the butt end of a pin, but allow the head end thereof to drop between them whet a pin reached the lower limit of its travel in a pocket.

Figure 4:
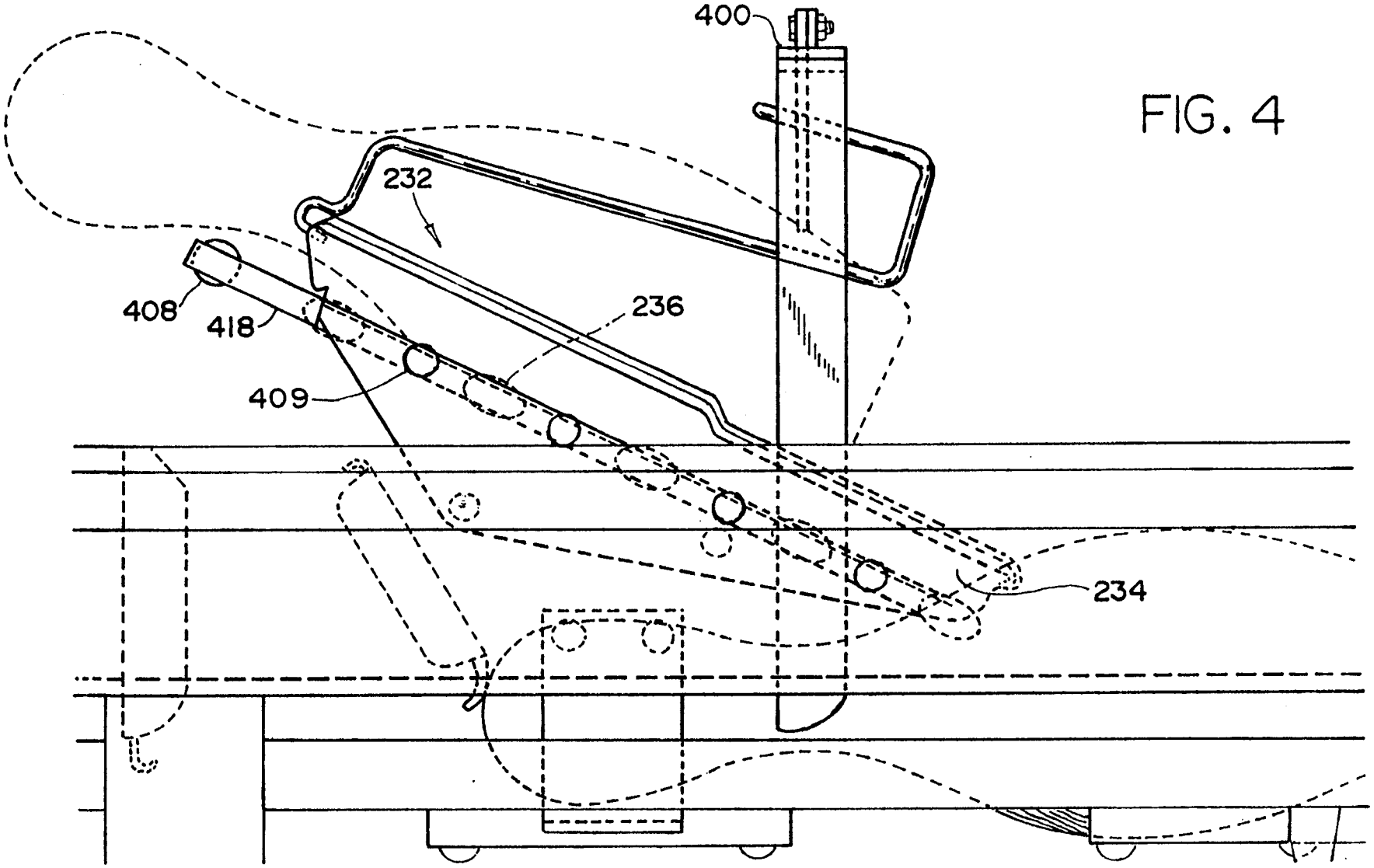
FIG. 4 is a partial side elevation of the #1 pin guides of the pinspotting machine of FIG. 1 as modified to incorporate the preferred embodiment of this invention.

Pin pocket 2 for the #1 pin comprises the same butt guide 220 and end plate 222 as in pockets 42 for pins #2–#6. However, its pin guides 232 are different from pin guides 230 of the other pockets. As shown in FIGS. 1 and 4, pin guides 232 comprise elongated plates 234 having outwardly flared flanges 236 which support a plurality of non-friction ball bearing rollers 238 similar to rollers 128 on carriage arms 126. Rollers 238 are so mounted that they are parallel to the radial line of each pin delivered into pocket 42 of #1 pin. Pocket 42 for #1 pin was provided with additional upwardly extending side guides intended to assist in directing the top pin in this pocket downwardly thereinto when the lower pin is delivered into the #1 spotting cup.

Two similar laterally spaced brackets 242 are secured by bolts to front channel 218 of pin magazine 44. Each bracket is formed with a horizontal arm 244 provided with a vertical bore by means of which magazine 44 can yield on or move vertically on pins 246 mounted in horizontal legs of channel 247 attached to connecting member 212. Provision also is made for the rear end of magazine 44 to yield or move upwardly by means of a bracket support 248 attached at each end of channel 216. Bracket supports 248 are mounted on channel 217 in such manner that they seat on the rear ends of upper frame members 200. Outer walls 250 of each bracket support 248 prevent substantial side movement of magazine 44. Legs 252 of these supports are so spaced vertically from each other that adequate upward yielding movement of magazine 44 can occur when and if the necessity therefor arises.

The top and bottom of each butt guide 220 and the pin engaging edges of all other guides and members are rounded or curved in order to prevent damage to pins delivered into pin pockets 42.

A head pin roller guide is attached to the storage area at the entrance point for the number 1 bin, the purpose of this guide is to guide the number 1 bowling pin into its storage area after it leaves the end of the distributor. Frequently, the number 1 pin will jam as it passes along the head pin roller guide.

The present invention includes a device to be attached to the head pin roller guide 232 in the field to prevent the pin from jamming as it traverses the head pin roller guide. The device comprises a generally arch shaped structure 400, mounted over the lower portion of the head pin roller guide from which a resilient pendent 404 hangs so as to be in the path of the head pin as it traverses the guide. Attached between the arch shaped structure and the front of the head pin roller guide on each side, are side guide rods 406 and 407 which tend to prevent the head pin from jumping or yawing to the left or right as it traverses the head pin roller guide. Additional rollers 408 have been added to the head pin roller guide to extend the length of the guide and four rollers 409 have been added between the existing five rollers on each side to make a total of 10 rollers on each side. The additional rollers, and particularly extension of the rollers closer to the distributer discharge smooth the transition between the distributor and the storage area, reduces the unsupported distance the pin must traverse and reduces wear on all of the rollers.

The arch shaped structure 400 in the present embodiment is fashioned from bar stock although it will be obvious that other materials may be utilized. The arch and guide rods are attached to the existing structure of the #1 pocket at four points. The lower legs 410 and 412 of the arch are attached to the existing mounting holes in the side walls of the pocket provided by the manufacturer of the machine with bolts 413 and nuts 415 passing through bushings 417 respectively while the ends 414 and 416 of the side guide rods 406 and 407 are hooked under the rear of the pin guides. In installing the device the ends of the side guide rods are first hooked over the rear of the pin guides and then the lower legs of the arch are bolted to the sides of the #1 pocket.

In order to facilitate the modification of the thousands of machines to which this invention can be adopted to improve their performance, a kit may be provided containing all the parts necessary to modify existing pinspotting machines. The parts in this field installation kit can all be installed with simple, readily available hand tools. This field installation kit would include the following parts:

a. a U shaped arch support 400 member as shown herein;
b. two side rails 406 and 407;
c. a resilient pendent 404 attachable to the top of the U shaped support;
d. two elongated bars 418 each having holes in one end for mounting the bars to the sides of the existing roller guides for the #1 pin pocket, the mounting holes being in positions corresponding to the holes in which the existing ball bearing rollers are mounted on the outwardly flared flange an the pinspotting machines as described in U.S. Pat. No. 3,526,401 and ball bearing rollers 408 attached to the other end of each elongated bar;
e. an additional eight ball bearing rollers 409 for mounting between the existing five ball bearings on each side of the elongated plates of the pin guides for the #1 pin pocket, these additional ball bearings while not being essential, do tend to reduce the wear of the existing ball bearings and provide smooth movement for the #1 pin.
f. bushings for mounting the U shaped bracket, bolts, washers and nuts as necessary.

Figure 5:
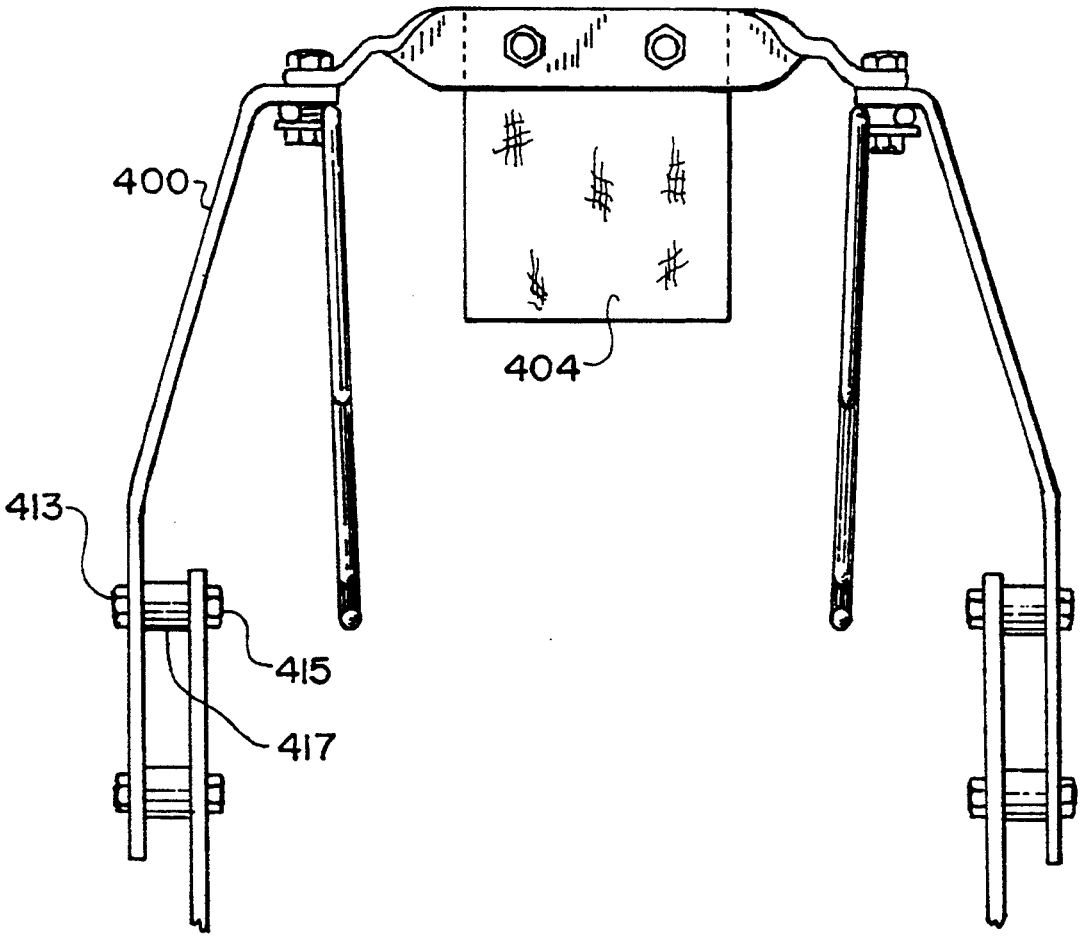
FIG. 5 is an end elevation taken along lines 6—6 in FIG. 4 and showing part of the invention as mounted on the pocket of the #1 pin.
Figure 6:
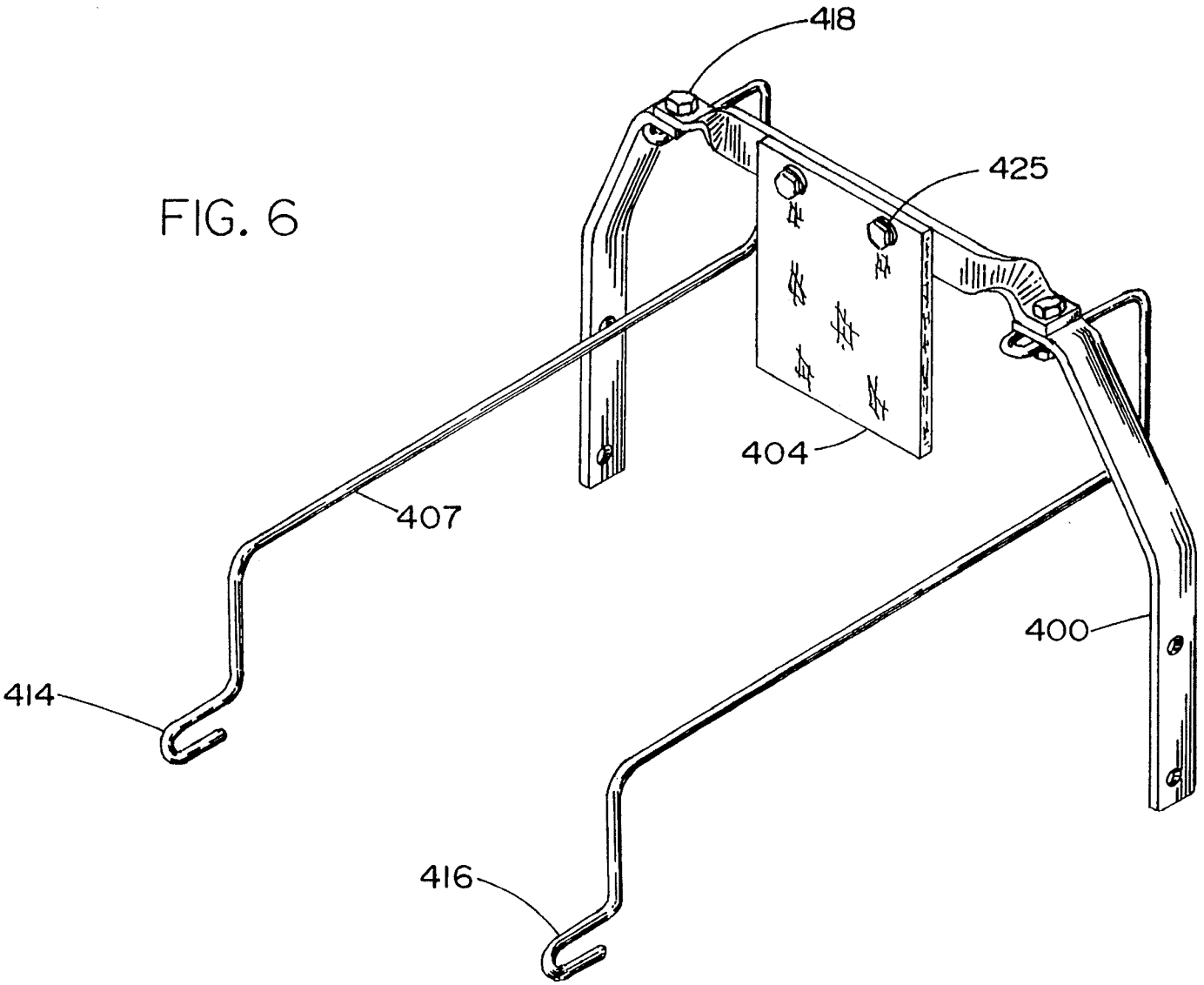
FIG. 6 is a prospective view of the U shaped arch and the side rail assembly shown in FIG. 5 and FIG. 6.

During field installation the front of the side rails 406 and 407 are attached to the U shaped bracket by bolts 413 and nuts 415 as shown in FIG. 5. Similarly, the pendent 404 is attached to the U shaped bracket 400 by bolts or other fasteners. To mount the assembly, the hooked shaped rear ends 414 and 416 of the side rails are "hooked" over the rear of the pin guides and the lower ends of the U shaped bracket are attached to the sides of the pocket utilizing bolts passing through holes in the sides of the pocket to which were formerly mounted the upward side guides shown as 240 in U.S. Pat. No. 3,526,401. Once the bolts are attached, the rear ends of the side rails cannot become unhooked and the assembly is fixed to the existing pinspotting machine with a minimum of effort. Similarly the additional ball bearings and the elongated bars carrying the extension rollers can be mounted to the sides of the existing ball bearing mounting plates.

It will be obvious to those skilled in the art that many changes can be made both in the details of construction and arrangements of parts without departing from the scope of the invention as defined in the appended claims.

What is claimed is:

1. In a bowling pinspotting machine of the type having a distributor mechanism for distributing and feeding pins to a storage area of a shuttle in which the distributor comprises a conveyor belt terminating in a distributor trip lever, said storage area of the shuttle assembly having individual storage area for each bowling pin and the storage area for the #1 or head pin having a head pin roller guide along the sides thereof for guiding the head pin as it moves between the end of the distributor and the individual storage area for the head pin, the head pin roller guide comprising guide rollers at the upper edge of the narrower rearward portion of the headpin pocket or individual storage area keeping the bowling pins in a generally longitudinal direction with respect to the head pin guide assembly, the improvement comprising:

a. side rails or rods extending along the length of the head pin roller guide, said guide rails being adapted to deflect the head pin back into a longitudinal path if the headpin yaws more then a amount determined by the position of side rails as the head pin moves from the distributor into the headpin pocket or storage area of the shuttle assembly; and
b. resilient means suspended above the head pin roller guides, said resilient means being adopted to contact the top of the head pin as it moves longitudinally along the length of the head pin roller guide assembly so as to prevent the bowling pins from pitching more then a predetermined amount as the head pin moves from the distributor into the headpin pocket or storage area of the shuttle assembly.

2. The invention of claim 1 wherein the resilient means comprise;

a. a generally inverted U shaped arch extending over the center of the head pin roller guide in a transverse direction; and b. a resilient piece of sheet material attached to the top of the arched and extending down into the path of the headpin whereby the side of the base of the head pin will contact the bottom of the resilient material, the positioning and resiliency of the material being such that the movement of the pin will be dampened but not stopped as the pin moves along the head pin roller guide.

3. In a bowling pinspotting machine of the type described in claim 1 wherein the distance between the end of the distributor trip lever and the guide rollers at the upper edge of the narrower rearward portion of the headpin pocket is more then two and one half inches, the improvement comprising additional guide rollers mounted between the end of the trip lever and the existing guide rollers so as to reduce the distance between the end of the trip lever and the first guide rollers thereby reducing the unsupported distance that the pin must travel between the trip lever and the guide rollers and reducing the extremes of pin motion as the pin moves toward the pocket.

4. In a bowling pinspotting machine of the type described in claim 1, the improvement comprising additional guide rollers mounted between the end of the trip lever and the existing guide rollers so as to reduce the distance between the end of the trip lever and the first guide rollers thereby reducing the unsupported distance that the pin must travel between the trip lever and the guide rollers and reducing the extremes of pin motion as the pin moves toward the pocket.

5. The invention of claim 4 wherein the addition rollers are mounted on supports attached to the existing plates to which the previously existing guide rollers are mounted.

6. In a bowling pin respotting machine of the type having a distributor mechanism for feeding bowling pins to a shuttle in which the distributor mechanism comprises a conveyor belt terminating in a distributor trip lever which feeds bowling pins to the shuttle and the shuttle includes a headpin roller guide for guiding the headpin into its shuttle position after it is discharged from the end of the distributor trip lever, the improvement comprising:

a. side guide rails extending upwardly along the sides of the headpin roller guide; and b. resilient means suspended above the headpin roller guide, said resilient means being adopted to contact the area between the top of the base and the top of the belly of the #1 pin as it move longitudinally along the headpin roller guide toward the head pin pocket, whereby the pin is prevented from bouncing off the head pin roller guide.

7. The invention of claim 6, wherein the resilient means comprises and inverted U-shaped frame mounted above the headpin roller guide having resilient finger means extending downwardly into the path of the bowling pin, said resilient finger means being sufficiently long to contact the top of the pin to dampen and reduce bouncing of the pin while not interfering with the movement of the pin in a longitudinal direction toward the number 1 pocket.

8. An improvement to a bowling pin handling apparatus for use with a bowling pinspotting machine of the type comprising an elongated, contractible-expansible, variable length distributing belt conveyor, a pin storage magazine, means mounting said magazine beneath said bell conveyor, a plurality of pin receiving and storing pockets arranged in generally triangular formation in said magazine, means pivotally mounting one end of said belt conveyor whereby the other end thereof can swing freely back and forth above said pockets, means for moving said belt conveyor across said magazine to deliver bowling pins into said pockets and means for varying the length of said belt conveyor to effect the successive delivery of pins from the end of said belt conveyor into selected pockets, a frame provided with a plurality of pin supports conforming in arrangement with the arrangement of said pockets in said magazine, means mounting said frame for movement beneath said magazine, and means for moving said frame in a substantially horizontal plane beneath said magazine to effect the discharge of a single pin from each of said pockets; and wherein each of said pockets in said magazine comprises spaced downwardly inclined pin guides, a butt guide and a pin head rest, and wherein said pin supports on said frame coact with said pin head rest to support the butt end of a pin while said head end of the pin rests on said head rest, said pin while so supported in a pin pocket being positioned with its longitudinal axis lying substantially in a horizontal plane; and wherein said pin guides of the pin pocket holding the #1 pin are substantially longer than the pin guides for the #2–#10 pin pockets, and non-friction rollers mounted on said #1 pocket pin guides for radial engagement with a bowling pin for guiding a pin delivered from said distributing conveyor into said #1 pocket, wherein the improvements comprises:

a. side rails or rods extending along the length of the head pin roller guide, said guide rails being adapted to deflect the head pin back into a longitudinal path if the headpin yaws more then a amount determined by the position of side rails as the head pin moves from the distributor into the headpin pocket or storage area of the shuttle assembly; and b. resilient means suspended above the head pin roller guide, said resilient means being adopted to contact the top of the head pin as it moves longitudinally along the length of the head pin roller guide assembly so as to prevent the bowling pins from pitching more then a predetermined amount as the head pin moves from the distributor into the headpin pocket or storage area of the shuttle assembly.

9. The invention of claim 3 wherein the resilient means comprise;

a. a generally inverted U shaped arch extending over the center of the head pin roller guide in a transverse direction;and b. a resilient piece of sheet material attached to the top of the arched and extending down into the path of the headpin whereby the side of the base of the head pin will contact the bottom of the resilient material, the positioning and resiliency of the material being such that the movement of the pin will be dampened but not stopped as the pin moves along the head pin roller guide.

* * * * *